United States Patent [19]

Wells

[11] Patent Number: 4,826,406

[45] Date of Patent: May 2, 1989

[54] PRESSURE EXTRACTION PUMP SYSTEM FOR RECOVERING LIQUID HYDROCARBONS FROM GROUND WATER

[75] Inventor: Samuel L. Wells, Lilburn, Ga.

[73] Assignee: S&ME, Incorporated, Raleigh, N.C.

[21] Appl. No.: 106,637

[22] Filed: Oct. 8, 1987

[51] Int. Cl.[4] ..... F04F 1/06; F04B 47/02

[52] U.S. Cl. ..... 417/120; 417/138; 166/372

[58] Field of Search ..... 417/118, 137, 138, 120, 417/126, 129, 130, 131, 132, 134, 135, 136, 144, 145, 125, 139, 141, 142, 143; 166/105, 372

[56] References Cited

U.S. PATENT DOCUMENTS

| | | | |
|---|---|---|---|
| 129,353 | 7/1872 | Lytle | 417/118 |
| 751,323 | 2/1904 | Moran et al. | 417/118 |
| 801,981 | 10/1905 | Gosse | 417/118 |
| 964,693 | 7/1910 | Richardson | 417/118 |
| 984,329 | 2/1911 | Weber | 417/123 |
| 1,437,939 | 12/1922 | Green | 166/105 |
| 1,724,855 | 8/1929 | Small | 417/139 |
| 1,724,858 | 8/1929 | Small | 417/142 |
| 2,171,402 | 8/1939 | Muir | 137/209 |
| 2,242,166 | 5/1941 | Bennett | 166/105 |
| 2,450,140 | 9/1948 | Hawley, Jr. | 417/139 |
| 2,580,332 | 12/1951 | Teetor | 166/64 |
| 2,630,178 | 3/1953 | Brown | 166/4 |
| 2,777,399 | 1/1957 | Clark, Jr. | 417/149 |
| 3,071,189 | 1/1963 | Colvin et al. | 166/68 |
| 3,092,143 | 6/1963 | Denman | 137/624.14 |
| 3,288,081 | 11/1966 | McMillan | 417/147 |
| 3,289,691 | 12/1966 | Kennard | 137/496 |
| 3,425,555 | 2/1969 | Ridgeway | 210/65 |
| 3,617,152 | 11/1971 | Cummings | 417/54 |
| 3,628,607 | 12/1971 | Dietz | 166/305 R |
| 3,647,319 | 3/1972 | McLean et al. | 417/143 |
| 3,873,238 | 3/1975 | Elfarr | 417/118 X |
| 3,894,583 | 7/1975 | Morgan | 166/68 |
| 3,901,811 | 8/1975 | Finch | 210/538 |
| 3,931,831 | 1/1976 | French | 137/525 |
| 3,991,825 | 11/1976 | Morgan | 166/68 |
| 4,025,237 | 5/1977 | French | 417/131 |
| 4,187,912 | 2/1980 | Cramer | 166/314 |
| 4,222,440 | 9/1980 | Parker | 166/314 |
| 4,252,649 | 2/1981 | Favret, Jr. | 210/800 |
| 4,273,650 | 6/1981 | Solomon | 210/104 |
| 4,295,975 | 10/1981 | Walin | 210/800 |
| 4,435,292 | 3/1984 | Kirk et al. | 210/747 |
| 4,489,779 | 12/1984 | Dickinson et al. | 166/64 |
| 4,497,370 | 2/1985 | Breslin | 166/372 |
| 4,527,633 | 7/1985 | McLaughlin et al. | 166/370 |
| 4,546,830 | 10/1985 | McLaughlin et al. | 166/370 |
| 4,625,801 | 12/1986 | McLaughlin et al. | 166/267 |
| 4,625,807 | 12/1986 | Harlow | 417/118 X |
| 4,678,040 | 7/1987 | McLaughlin et al. | 166/370 |
| 4,725,202 | 2/1988 | Zison | 417/138 |

FOREIGN PATENT DOCUMENTS 1367088 6/1964 France .

OTHER PUBLICATIONS

Ejector Systems, Inc. brochure (no date), published by Ejector Systems, Inc., 921 National Avenue, Addison, Ill. 60101.

Pump Engineer Associates, Inc. brochure (1983), published by Pump Engineer Associates, Inc., 921 National Avenue, Addison, Ill. 60101.

*Primary Examiner*—Leonard E. Smith
*Assistant Examiner*—Leonard P. Walnoha
*Attorney, Agent, or Firm*—G. H. Telfher

[57] ABSTRACT

There is disclosed a pressure extraction pump system for recovering liquid hydrocarbons from contaminated ground water collected in a well. The pump system includes a pump with a pump vessel and an open top sleeve extending above the pump vessel for skimming the upper portion of the liquid collected in a well bore. The pump also includes a liquid level sensing device for sensing the level of the liquid in the sleeve and activating a pumping cycle. The pump also has a quick closing intake valve.

9 Claims, 6 Drawing Sheets

PRESSURE EXTRACTION PUMP SYSTEM FOR RECOVERING LIQUID HYDROCARBONS FROM GROUND WATER

BACKGROUND OF THE INVENTION

This invention relates generally to pressure extraction pumping systems for recovering liquid hydrocarbons from ground water, and more particularly concerns a pressure extraction pump system which can be used to skim free floating hydrocarbon liquid from ground water in a well bore.

At petroleum handling facilities such as refineries, storage facilities, terminal facilities, and gasoline stations, spillage of liquid hydrocarbons can result in the contamination of ground water in the immediate vicinity. The problem of ground water contamination can occur as a result of slow leakage over time or a more catastrophic spillage event. In either case, the liquid hydrocarbons seep through the ground to the ground water table level. Because liquid hydrocarbons have specific gravities that are less than water and are generally immiscible with water, they form a layer on top of the ground water table.

Conventionally, in order to remove the contaminating liquid hydrocarbons from the ground water, it has been necessary to drill a number of bore holes in the area where the contamination exists and then pump large quantities of ground water out of the bore holes to create a cone of depression in the ground water table adjacent each of the well bores. Gravity forces the liquid hydrocarbons to flow toward the center of the cones of depression, and the liquid hydrocarbons callect there within each bore. In some areas where the aquifer is particularly prolific, it may be necessary to pump very large quantities of ground water before even a shallow cone of depression can be created. Moreover, in tidal areas, the rise and fall of the tiedes may, within the context of a prolific aquifer, make it impossible to achieve a stationary cone of depression no matter how much ground water is pumped to the surface.

Conventionally, it is known that the deeper the cone of depression, the thicker the free floating layer of liquid hydrocarbons will be on top of the ground water at the center of the cone of depression. A thick layer of liquid hydrocarbons facilitates recovery of the liquid hydrocarbons with a minimum amount of water. Obviously, where a prolific aquifer exists, the cone of depression will necessarily be shallow, the layer of free floating liquid hydrocarbons will be thin, and a large amount of ground water will have to be pumped to the surface as a percentage of the free floating liquid hydrocarbons that are removed. The more ground water that is pumped to the surface, the greater the expense is in separating the liquid hydrocarbons from the ground water.

In connection with a catastrophic spill, the spill forms a dispersion dome from the point of the spill generally expanding outward into a cone of descent toward the static water table. Within time, the liquid hydrocarbons begin to settle onto the existing static water table and begin to depress it forming a layer of liquid hydrocarbons below the point of spill within the expanded cone of descent. If a bore is made at the point of spill, the liquid that collects in the well bore will have a fairly thick layer of liquid hydrocarbons. In order to exploit the fact that the liquid hydrocarbons are in a somewhat concentrated area beneath the point of the spill, and before the liquid hydrocarbons have dispersed due to their own hydraulic head and general ground water flow, it is advantageous to pump as much of the liquid hydrocarbon out of the well bore as soon as possible. Early removal of the concentrated liquid hydrocarbons reduces the hydraulic head of liquid hydrocarbons and helps minimize the lateral spreading of the contamination.

Normally where ground water clean up is to be undertaken it is necessary to acquire permits from environment protection agencies before the decontaminated ground water can be discharged from the site. In most spillage cases where the public health and safety are not immediately effected, there may be administrative delays in acquiring such permits and until such permits are acquired, any water that is pumped to the surface must be stored or trucked away to an approved disposal treatment site until such time as the requisite permit to discharge the ground water has been acquired. It is therefore important, during the early phase of a clean up of a catastrophic spill, while the liquid hydrocarbons remain concentrated beneath the spill and when no discharge permit is available, that the minimum amount of ground water as a percentage of the liquid hydrocarbons be pumped to the surface. In order to exploit the situation, it is necessary that the intake of the pump be located within the liquid hydrocarbon layer so that the smallest amount of ground water is pumped to the surface.

While the prior art indicates an understanding that it is important to locate the pump intake at the level of the liquid hydrocarbon layer, achieving that result, as a practical matter, is very difficult, McLaughlin et al. U.S. Pat. No. 4,527,633 discloses a pump which has a separate inlet for the pump vessel which inlet is attached to a float and rides up and down on the water table along the cable. The inlet is connected to a flexible tubing which is in turn connected to the vessel pump chamber. The pressure that forces the liquid hydrocarbons into the inlet is limited by the amount of the liquid hydrocarbons existing above the opening to the inlet. If the float rides high in the liquid hydrocarbons, the head is reduced, and the time required to fill the pump vessel is increased. Moreover, within a tidal area where the water table may vary as much as two feet or more during the course of a 24 hour period, the flexible tubing attached to the inlet would not accommodate such changes in the water table.

In addition to collecting as much of the liquid hydrocarbon as possible as a percentage of the ground water, it is also important that the pump operate as efficiently as possible. In that regard, where extraction pressure pumps such as those shown in the McLaughlin et al. are used, the pump operates by allowing the fluid in the well bore to enter the pump vessel through an inlet under the static head pressure of the liquid in the bore. Once the vessel has filled, either as a function of time or as a function of a sensed level of liquid in the vessel, the vessel is pressurized by means of compressed gas pumped from the surface. The compressed gas forces the intake valves closed and then forces the fluid in the pump vessel to the surface. In order to pump efficiently, it is necessary that the top intake valve close even before the vessel is pressurized so that the rising head of liquid in the well bore and the pressurizing air do not force the free floating liquid hydrocarbons out of the top intake valve. Closing the top intake valve once the vessel is filled not only minimizes the loss of liquid hydrocarbons during each pumping cycle but also minimizes turbulence which tends to emulsify and mix the liquid hydrocarbons with the ground water resulting in greater costs in the ultimate separation process at the surface. Also the valve open area to receive fluids must be maximized as a percent of the extraction vessel's body diameter.

SUMMARY OF THE INVENTION

It is therefore an object of the present invention to provide a pressure extraction pump system that can be accurately located to skim all of the free floating liquid hydrocarbons from the surface of the ground water in a well bore.

It is likewise an object of the present invention to provide a pressure extraction pump system that assures that, when skimming the free floating liquid hydrocarbons from the surface of the ground water, the pump vessel fills with the liquid hydrocarbons first thereby minimizing the amount of groundwater that is pumped.

It is also an object of the present invention to provide a pressure extraction pump system in which a head of liquid is collected in a sleeve above the pump vessel, and the pump is activated by sensing the level of the liquid in the unpressurized sleeve.

It is an object of the present invention to provide a top intake valve with a large open area which valve closes once the pressure vessel has filled to improve pumping efficiency.

In order to achieve the foregoing objectives, a pressure extraction pump system of the present invention includes a well bore with a perforated casing extending through the static water table for collecting therein liquid hydrocarbons and ground water with the liquid hydrocarbons floating on top of the ground water. A pressure extraction pump vessel is suspended in the bore and includes a top intake port with a top intake valve, a pressurized gas inlet port, and a liquid outlet port. A sleeve, which is the same diameter as the pump vessel, is attached to the top of the pump vessel either directly or by means of a flexible conduit. The sleeve has an open top and forms a reservoir for liquid above the top intake port of the pump vessel. A liquid level sensor is located within the sleeve. The pump system also includes a pneumatic cylinder or rotary actuator attached at the well head for raising and lowering the pump.

In a skimming mode of operation, the pump is lowered by the pneumatic cylinder into the liquid in the well bore, and the liquid hydrocarbons and ground water weir over the top edge of the sleeve and into the sleeve chamber. As the liquid weirs into the sleeve chamber, it builds up a hydrostatic head which forces the liquid into the top intake port of the pump vessel. Once the pump vessel has filled and the liquid reaches a predetermined level within the sleeve, the level sensor causes a control means to connect a source of pressurized gas to the gas inlet port thereby pressurizing the pump vessel and forcing the liquid in the pump vessel to the surface. At the same time the pressurized gas is connected to the inlet port, the pressurized gas is also connected to the pneumatic cylinder at the well head which retracts to pull the pump up and out of the liquid in the well. Once the pump vessel has been evacuated and the liquid in the sleeve has dropped below the sensor's predetermined level, the pump is lowered again into the liquid to assure that the first liquid to weir into the sleeve is primarily the floating liquid hydrocarbons. The pump is lowered by the pneumatic cylinder at a rate that allows the vessel to fill up with the liquid previously trapped in the sleeve before the liquid hydrocarbons weir into the sleeve from the well bore. As a consequence, the pump skims the free floating liquid hydrocarbons from the top surface of the ground water thereby resulting in a minimum of ground water pumped to the surface.

The pressure extraction pump system of the present invention may also be used in a standard pumping mode. In the standard mode, the pump vessel has a second intake valve adjacent the bottom which allows ground water to enter the vessel while the liquid hydrocarbon enters through the sleeve and the top intake port. The intake of the ground water through the bottom valve creates and maintains the cone of depression. The bottom intake of ground water also lowers the level of liquid in the well casing momentarily to assist in the intake of the liquid hydrocarbons captured in the sleeve. The combined action of the bottom valve and sleeve assure constant equilibrium in the cone of depression and the removal of all of the free floating liquid hydrocarbons in the well bore with each pumping cycle.

In addition, in order to assure efficient pumping, the pressure extraction pump system of the present invention includes a top intake valve which closes when the pressure vessel is full of liquid and before the pressurization of the pump vessel to assure that floating liquid hydrocarbons in the pump vessel do not escape back through the intake port while the sleeve is filling and during the pumping cycle.

The pumping cycle may be carried out by means of series of timed air pulses so that the pump is pressurized for a predetermined period of time and then vented to atmosphere through a quick release depressurization valve. By using pulsed air, the logic circuitry at each well head may be reduced.

Other objects and advantages of the invention will become apparent upon reading the following detailed description and upon reference to the drawings.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
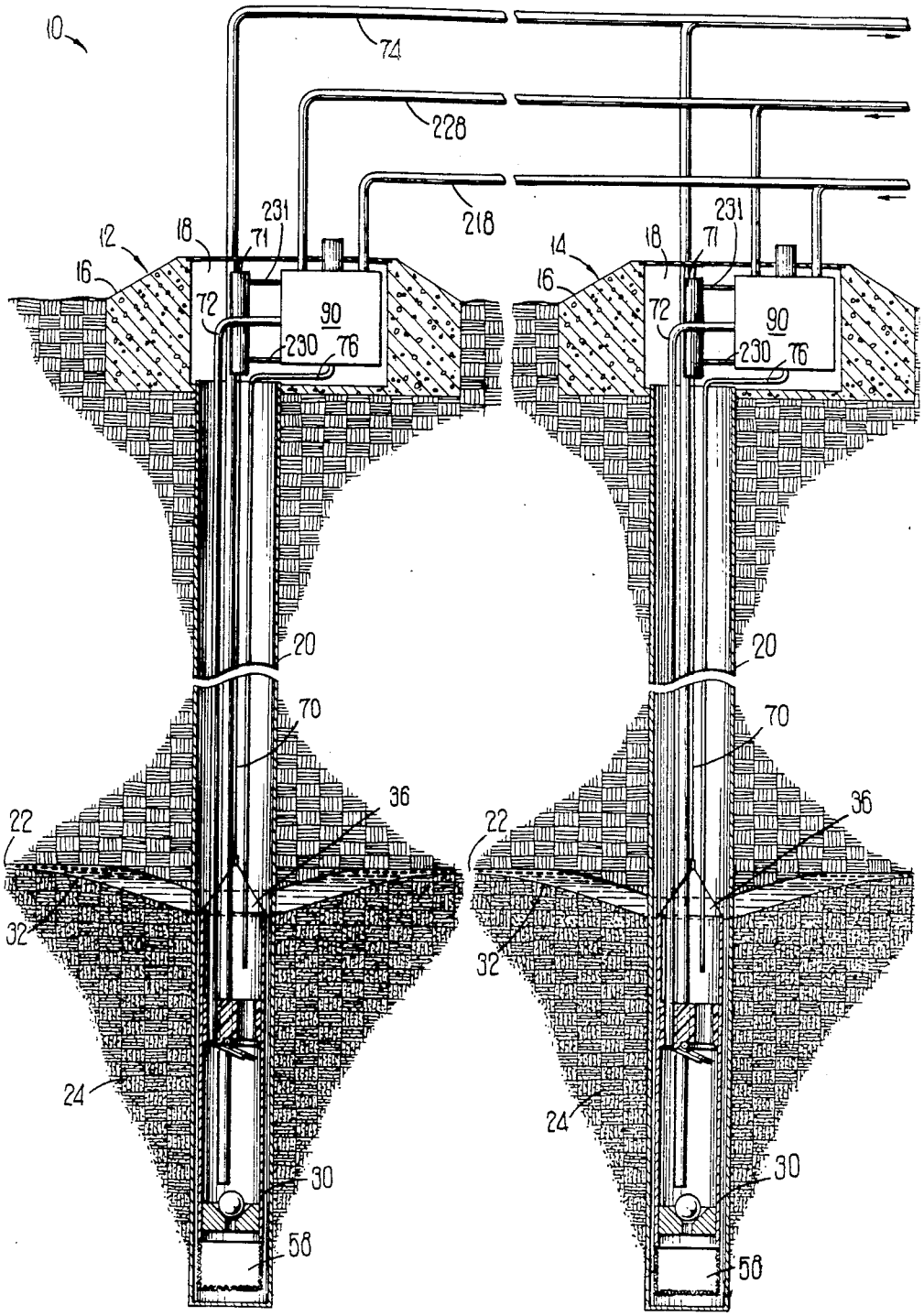
FIG. 1 is a schematic elevation view in cross-section showing multiple wells using the pressure extraction pump system of the present invention.

Turning to FIG. 1, there is shown a pressure extraction pump system 10 for use in connection with wells 12 and 14. The wells 12 and 14 represent just two of what may be a number of wells located around a clean up site in order to extract liquid hydrocarbons that have contaminated the ground water within aquifer 24. The pump system 10 as shown in FIG. 1 is being used in a standard pumping mode in which both the liquid hydrocarbons and the ground water are pumped to the surface in order to form a cone of depression 32 around each well for collection of the liquid hydrocarbons that have contaminated the aquifer 24.

Particularly, each well includes a concrete vault 16 with a compartment 18 in which the various controls for the pump system are housed and protected from the environment. Each well also includes a well casing 20 which is perforated pipe extending from the surface, through the static water table level 22, into the aquifer 24. The water bearing soil 24 below the static water table level 22 is saturated with ground water which is contaminated with liquid hydrocarbons.

In order to remove the liquid hydrocarbons from the ground water contained within the aquifer 24, a pump 30 embodying the present invention is lowered into the well casing 20. In the standard pumping mode, the pump 30 collects both the liquid hydrocarbons and ground water in the well casing 20 and pumps them to the surface as will be explained in greater detail below. As a consequence of continuous pumping of both liquid hydrocarbons and ground water, the cone of depression 32 is formed in the static water table adjacent the casing 20. The cone of depression 32 results because the liquids in the well casing are pumped to the surface faster than the aquifer 24 can replenish the ground water liquid around the well casing. Consequently, in a non-profilic aquifer, a fairly deep cone of depression 32 may be created, whereas in the case of a prolific aquifer, the cone of depression will be relatively shallow at the well casing.

.The cone of depression 32 provides a gravitational gradient which will cause the liquid hydrocarbons trapped in the surrounding aquifer 24 to gravitate along the cone of depression to the well casing where they will collect on top of the ground water in the well casing to form a layer 36 of free floating liquid hydrocarbons on top of the ground water in the well casing. The steeper the cone of depression 32 is, the faster the layer 36 of liquid hydrocarbons will be replenished by the aquifer in the well casing.

Once the cone of depression 32 has been established, it is necessary to pump ground water from the well casing in order to maintain the cone of depression. Also, with each pumping cycle all of the free floating liquid hydrocarbons in layer 36 within the well casing should be collected and pumped to the surface. In order to achieve that objective, the pump 30 intakes the free floating hydrocarbons in layer 36 first while at the same time intaking enough ground water to maintain the cone of depression.

Figure 3A:
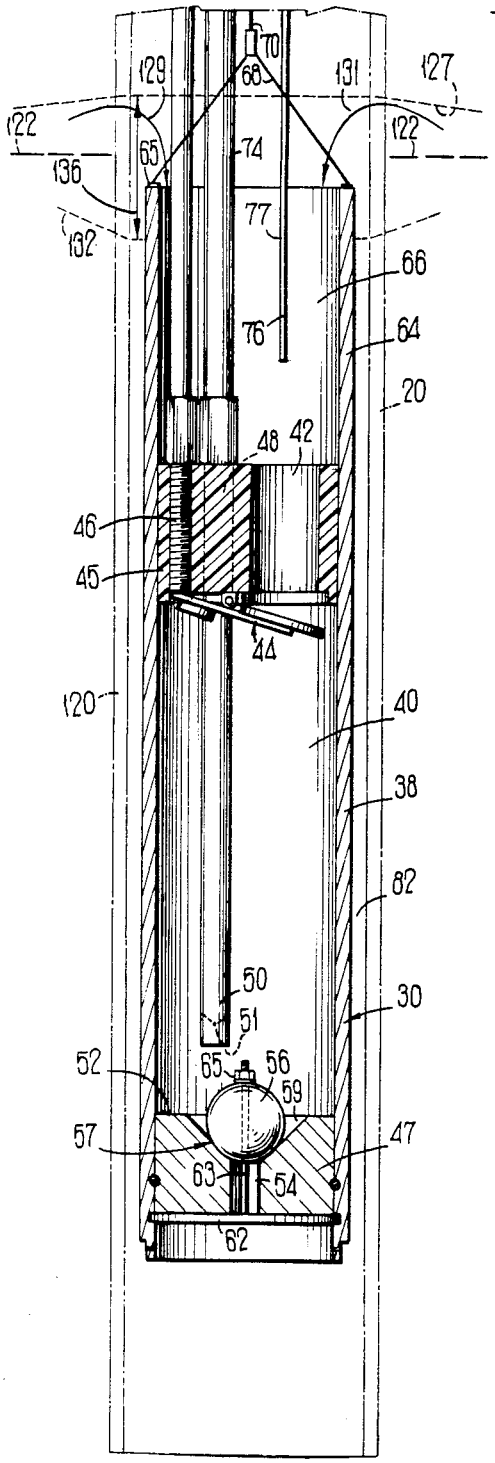
FIGS. 3A and 3B are elevation section views of the pump vessel and attached sleeve of the present invention.
Figure 3B:
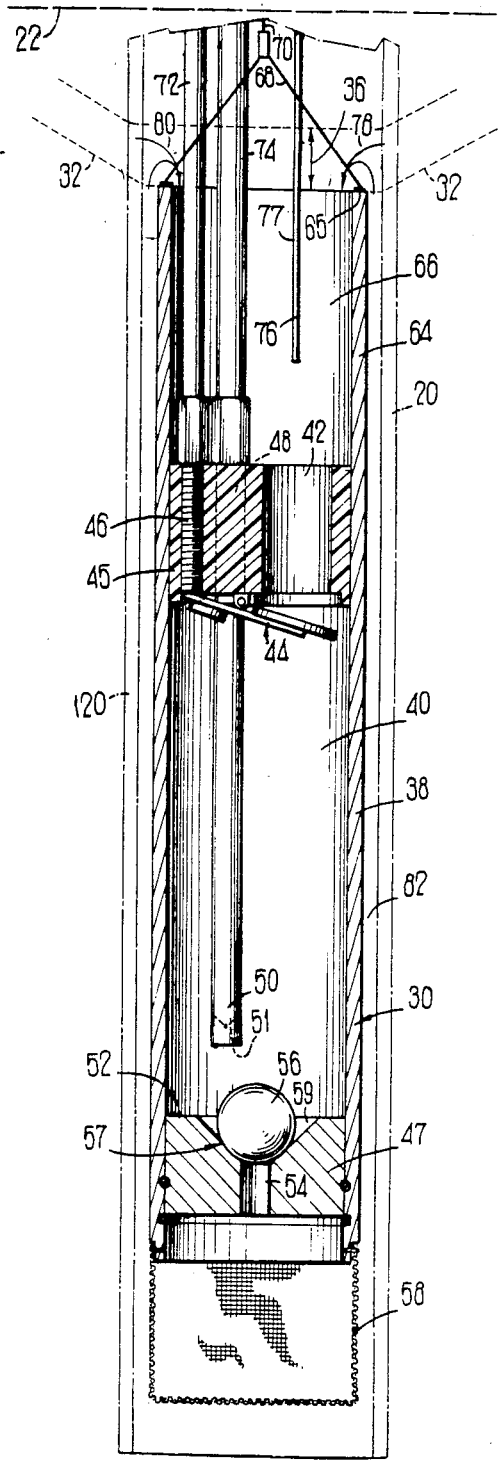

Turning to FIG. 3B. it can be seen that the pump 30 when used in the standard pumping mode includes a cylindrical vessel 38 with a top plug 45 and a bottom plug 47 which define an enclosed vessel chamber 40. The vessel 38 has a top intake port 42 with a top intake valve 44. The vessel 38 also has a gas inlet port 46 and a liquid outlet port 48. The outlet port 48 includes pipe 50 which extends into the vessel chamber 40 to near the bottom plug 47 of the vessel chamber. The pipe 50 has a check valve 51 which precludes liquid flow back into the vessel chamber 40 from pipe 50. The vessel 38 also has a bottom intake port 54 with a bottom intake check valve 57 comprising ball 56 and seat 59. The bottom intake port 54 is surrounded by an intake screen 58.

The pump 30 also includes a top sleeve 64 which defines a sleeve chamber 66. The sleeve chamber 66 and the vessel chamber 40 are separated from each other by the top plug 45 and have approximately equal cross-sectional areas. A bail 68 is connected to the top 65 of the sleeve 64 and is used for suspending the pump 30 within the casing 20 by means of cable 70. The cable 70 is connected to one end of pneumatic cylinder 71 at the well head (FIG. 1).

A pipe 72 conducts compressed air or other gas from the surface to the gas inlet port 46 in order to pressurize the vessel chamber 40 during the pumping cycle. The compressed air forces the liquid collected in vessel chamber 40 up through pipe 50, through outlet port 48, through pipe 74, and to the surface. The pump 30 also includes a sensor pipe 76 which extends into the sleeve chamber 66.

In the standard pumping mode, the pump 30 (FIG. 3B) is located in the well casing so that in equilibrium the top 65 of the sleeve 64 is just even with the level where the cone of depression 32 intersects the well casing 20. The liquid hydrocarbons in layer 36 within the well casing 20, weir into the sleeve chamber 66 as indicated by arrows 78 and 80. The first liquids in the well casing 20 to weir into the sleeve chamber 66 are primarily the liquid hydrocarbons in layer 36. As the liquid flows into the sleeve, it collects in the vessel chamber 40. When the vessel chamber is full, valve 44 closes, and the liquid collects in the sleeve chamber 66 until it reaches a preset level 77 on the sense pipe 76. As will be explained in greater detail, once the liquid in the sleeve chamber 66 reaches level 77 of the sense pipe 76, it causes the pneumatic controls 90 at the well head 16 (FIG. 1) to initiate a pumping cycle. During a pumping cycle, control 90 connects compressed air to the pipe 72 which pressurizes vessel chamber 40. The pressurization of chamber 40 tightly seals top intake valve 44 and closes and seals bottom intake valve 56. Once the intake valves have sealed, the compressed air above the liquid collected in the vessel chamber 40 forces the liquid through check valve 51, pipe 50, outlet port 48, and pipe 74 to the surface where it is collected for further processing. The compressed air is delivered to pipe 72 and the vessel chamber for a first period of time (on time) which is preselected to evacuate the liquid collected in the vessel chamber 40. The vessel chamber 40 must be evacuated before the sleeve chamber 66 can fill up and overflow the top 65 of the sleeve. After the evacuation time (on time) has elapsed, the pipe 72 is exhausted to atmosphere for a second time period (off time). If at the end of the second time period the liquid has filled the vessel chamber 40 and accumulated to the level 77 of the sense pipe 76, the pump will cycle again. On the other hand, if during the second time period the liquid has not reached the level 77 of the sense pipe 76, the controller 90 will wait until the liquid has reached that level before another pump cycle is initiated.

During the waiting time (off time), the liquid hydrocarbons that collected in the sleeve chamber 66 flow into the vessel chamber 40 via top intake port 42. Simultaneously, ground water flows into the vessel chamber through bottom intake port 54 which flow causes the ground water in the annular space 82 between the well casing 20 and the pump vessel 38 to drop rapidly thereby producing additional hydrostatic head above the top intake port 42 to insure the liquid collected in the sleeve chamber 66 rapidly flows into the vessel chamber 40 via intake port 42. The drop in the level of liquid in the annular space 82 provides a space into which additional liquid hydrocarbons can flow creating an additional layer of liquid hydrocarbons in the annular space. As the liquid level in the casing rises the liquid in the vessel chamber 40 rises at the same rate. Once the level of the liquid in the vessel chamber 40 reaches the intake valve 44, the valve 44 closes so that the floating liquid hydrocarbons in the vessel chamber 40 are not forced back into the sleeve chamber 66. The liquid hydrocarbons that have collected on the rising liquid column in the annular space 82 are the first liquids to reach the top of the sleeve and weir into the sleeve chamber 66 (arrows 78 and 80). Once the sleeve has again filled to level 77, the pump cycles again.

Figure 4:
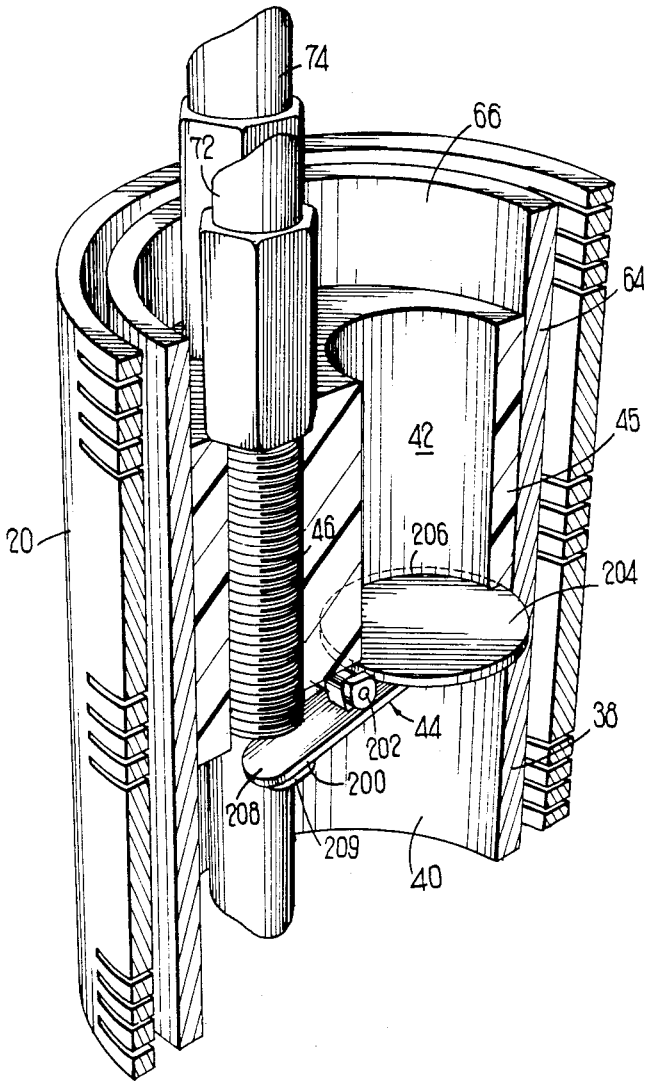
FIG. 4 is a detailed elevation view of the intake valve of the present invention.

The pumping efficiency of the pump 30 is enhanced by the design of the top intake valve 44 installed in top plug 45. In one embodiment (FIG. 4) the valve 44 comprises a beam 200 mounted on a pivot 202. A valve face 204 is loosely mounted on one end of the beam 200 so that it can engage and seat against the valve seat 206 cut in top plug 45. The other end 208 of the beam has a weight 209. The end 208 extends into alignment with gas inlet port 46. The beam 200 is balanced so that the valve is normally closed, and a small hydrostatic pressure above the valve will open it. Consequently, liquid in the sleeve chamber 66 above the top plug 45 can open the valve and enter the vessel chamber 40 through intake port 42. On the other hand when the vessel 40 is filled, there is no longer a hydrostatic head above the valve 44, and the valve 44 will close. When compressed air is supplied to gas inlet port 46 via pipe 72, the compressed air impinges against the end 208 of the beam 204 urging the valve face 204 into tighter engagement with the valve seat thereby sealing the intake port 42. The valve 44 insures that a minimum amount of floating liquid hydrocarbons in the vessel chamber 40 can escape back through intake valve 44 and further eliminates turbulence that might result at the intake valve 44 if it closed only after the vessel chamber 40 was pressurized.

Figure 7:
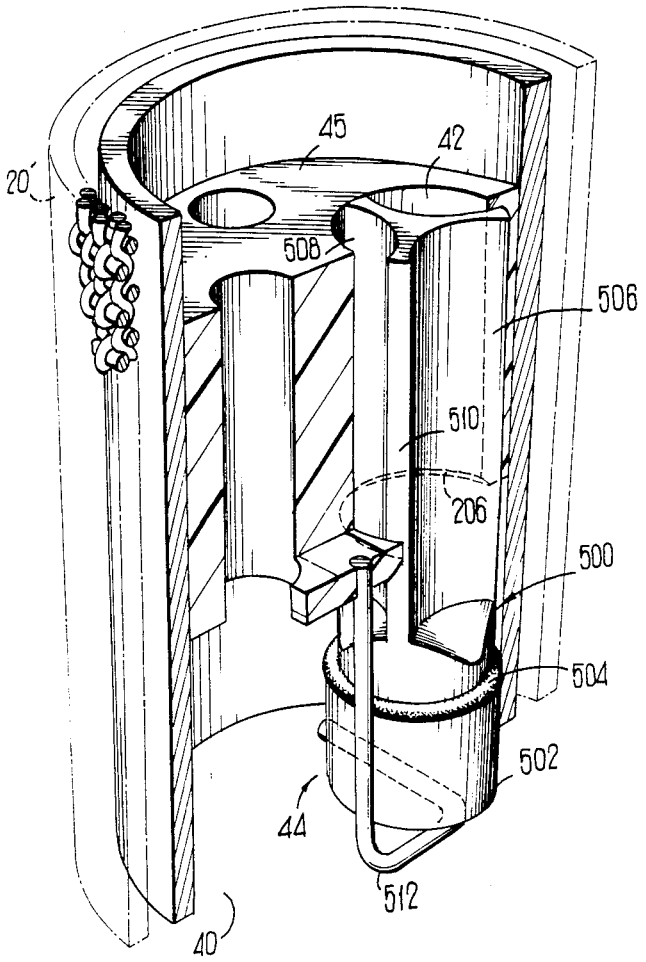
FIG. 7 is a detailed elevation view of another intake valve of the present invention.

In an alternative embodiment shown in FIG. 7, the intake valve 44 in top plug 45 comprises a valve stem 500 slideably mounted in intake port 42. The valve stem has a head portion 502 with an O-ring seal 504 (or alternatively a stainless steel washer) for engaging the valve seat 206 as the valve stem moves upward in FIG. 7. The valve stem also has a grooved portion 506 with grooves 508 and projections 510. The projections 510 engage the inside of the intake port 42 and serve as guides as the valve stem slides up and down within the intake port 42. The grooves 508 allow liquid to pass the valve stem 500 as the liquid presses through intake port 42. The valve stem 500 is held in the port 42 by means of wire keeper which is secured to top plug 45. The valve stem 500 is made of a plastic material that will float in the liquid water and hydrocarbons. Consequently, as the liquids fill vessel chamber 40, the valve stem 500 will float upward until the O-ring 504 seats on the valve seat 206 thereby closing the valve 44 and inhibiting the escape of liquid through intake valve 44.

Figure 5:
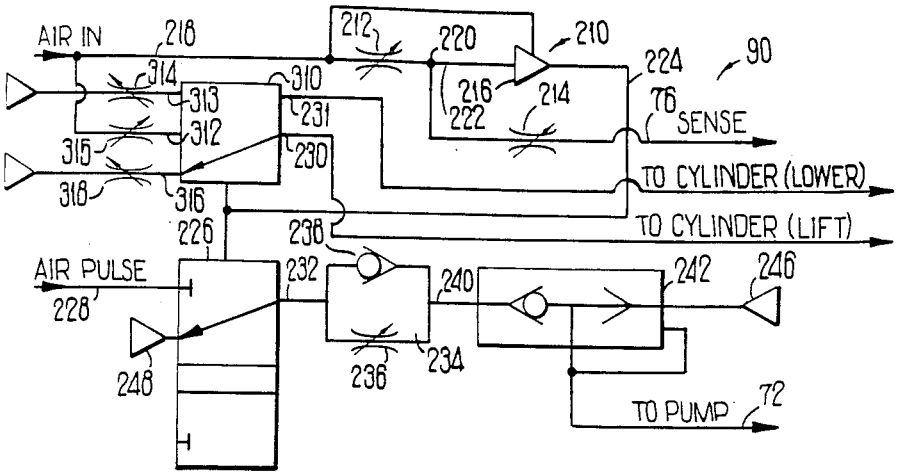
FIG. 5 is a schematic diagram showing the air logic used to control the pressure extraction pump system of the present invention when timed air pulses are used for pumping.

Turning to FIG. 5, there is shown a schematic diagram of the controller 90 which controls the operation of the pump 30 in either the standard pumping mode or the skimming mode. The controller 90 includes a sensing circuit 210 consisting of restrictors 212 and 214 and operational amplifier 216. The sense circuit 210 has a source of constant compressed air on input 218. The compressed air passes through restrictor 212 to the input of operational amplifier 216 and to the output restrictor 214 which is connected to the sense pipe 76 located in the unpressurized sleeve chamber 66 of the pump 30. As long as the liquid in the sleeve chamber 66 has not risen to the level 77 on the pipe 76, insufficient back pressure exists at pipe 76 and at node 220 to turn on operational amplifier 216. Once the liquid in the sleeve chamber 66 rises to the predetermined level 77, sufficient back pressure is created in pipe 76 so that enough air is diverted at node 220 from the sense pipe 76 to the input 222 of the operational amplifier 216 to turn on amplifier 216. By sensing the level in unpressurized sleeve chamber 66, the sensing circuit 210 does not have to be adapted to withstand the pump pressures that exist in the pressurized pump chamber 40.

When the operational amplifier 216 turns on producing air pressure at its output 224 it drives shuttle valve 226 to its on condition which connects input 228 to output 232. Input 228 pof shuttle valve 226 receives a timed pulse of air on line 228 which pulse is formed by conventional circuitry (not shown). Particularly, the air pulse on line 228 has an on time more than sufficient to evacuate the liquid from the vessel chamber 40 before the sleeve chamber 66 can fill to the top 65 and an off time set to allow the vessel and sleeve to fill back up to the predetermined level 77 in the sleeve.

The air pulse on input line 228 is connected by shuttle valve 226 to output 232 and then to flow control valve 234 which has a restricted forward path through restrictor 236 and an unrestricted return path through check valve 238. The restrictor 236 restricts the air flow to assure that during the pulse time the vessel chamber 40 is evacuated to a level approximating the bottom of the tube 50. The air pulse at output 240 is then connected through quick exhaust valve 242 to the pump line 72. Once the air pulse ends, quick exhaust valve 242 reverses, an the line 72 is connected to exhaust port 246 thereby rapidly relieving the pressure in the vessel chamber 40. As a result of the release of the pressure from the vessel chamber 40, the liquid in the sleeve chamber 66 flows into the vessel chamber. If during the off time (unpressurized time) the level of liquid in the sleeve drops below the preset level 77, the sense circuit 210 turns off thereby causing shuttle valve 226 to return to its exhaust state with output line 232 connected to exhaust port 248. Consequently, any residual pressure in the lines of the circuitry is relieved through check valve 238 of the return path of flow control 234 and through the shuttle valve 226 to exhaust port 248. If on the other hand, the liquid in the sleeve had not dropped below the predetermined level 77 during the off time of the air pulse on line 228, the sensing circuit would have stayed on, thereby keeping the shuttle valve 226 in its on position so that when the next timed air pulse appeared at input 228, the pump would cycle again.

Figure 6:
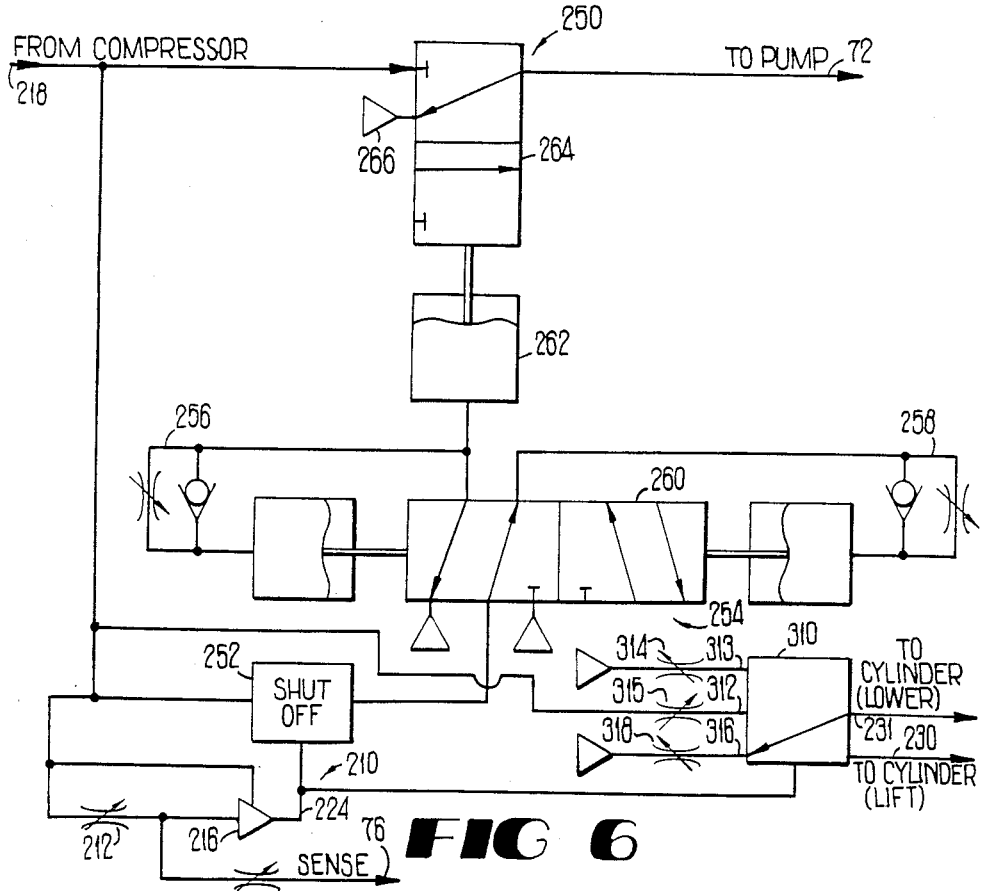
FIG. 6 is a schemtic diagram showing the air logic used to control the pressure extraction pump system when a constant air source is used for pumping.

In an alternative embodiment of the present invention, additional circuitry can be provided in controller 90 which will produce timed air pulse for each individual well. Turning to FIG. 6, there is shown an alternative control circuit 250 to replace controller 90 which alternative circuit 250 receives constant air pressure from a compressor on line 218. The circuit 250 includes a sensing circuit 210 which operates as previously described. The sensing circuit controls a shut off valve 252 which connects the compressed air on line 218 to timing circuit 254. The timing circuit 254 controls shuttle valve 260 and includes an on time restrictor 256 and an off time restrictor 258. The shuttle vale 260 alternatively provides air to and exhausts air from control cylinder 262 which in turn controls shuttle valve 264. Shuttle valve 264 alternatively connects the pump line 72 to the compressed air on input 218 or the exhaust port 266. The timing circuitry 250 is described in greater detail in U.S. Pat. No. 3,647,319.

Figure 2:
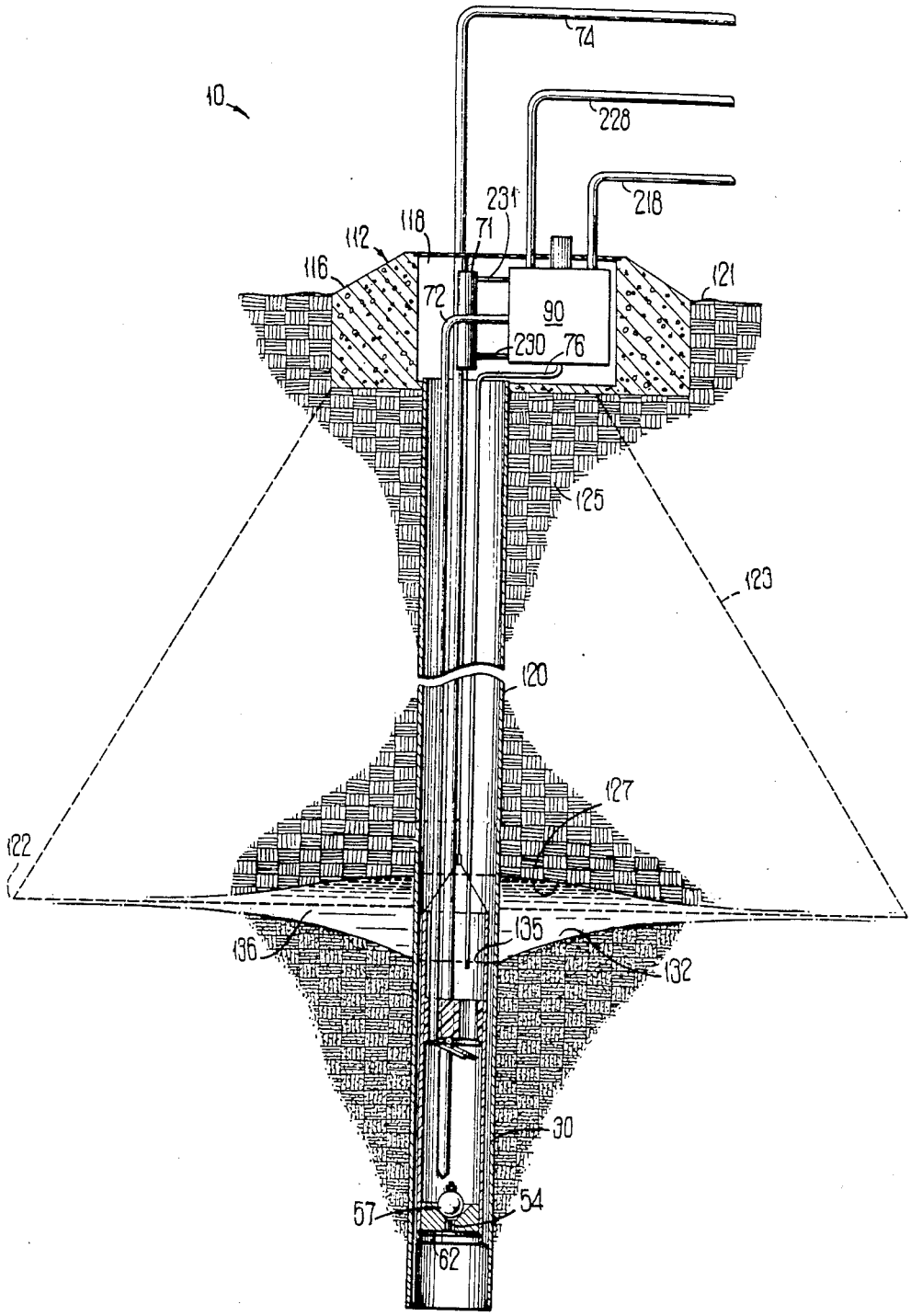
FIG. 2 is an enlarged schematic elevation view in cross-section showing a single well using the pressure extraction pump system of the present invention.

Turning to FIG. 2, the pump system 10 of the present invention is shown being used in connection with a catastrophic spillage event. Particularly, the pump system 10 in FIG. 2 is being used in the skimming mode. In addition to catastrophic spills, the skimming mode is also useful in connection with very prolific aquifers and particularly aquifers within tidal regions where the static water table may vary great distances over a 24 hour period. As can be seen in FIG. 2, there is illustrated one well 12 comprising a concrete vault 116 with a compartment 118 for housing the various control apparatus 90 of the pump system 112. In addition, the well 112 includes a porous casing 120 which extends from the center of the catastrophic spill to below the level of the static ground water table 122.

As a result of the catastrophic spill which occurred at the surface 121 and at the center line of the well casing 120, the spilled liquid hydrocarbons descend along a cone 123 of descent toward the static water table 122. As the liquid hydrocarbons percolate through the soil 125 within the cone of descent 123, the liquid hydrocarbons may collect in a dome 127 centered about the well casing 120 and depress the static water table into a shallow cone of depression 132. The dome 127 produces a thick layer 136 of liquid hydrocarbons in the well casing above the ground water level 135. Consequently, at the early stages of a catastrophic spill, there exists in the well casing 120 a relatively thick layer 136 of free floating liquid hydrocarbons. Because it may not be possible to secure the necessary permits to discharge on site the ground water pumped to the surface during the initial clean up, it is critical that the pump system 10 extract primarily the liquid hydrocarbons in the layer 136 and pump as little groiund water as possible. In that regard, in the skimming mode, the pump 30 (FIG. 3A) which has been previously described has its bottom intake port 54 closed off by means of a plate 62 which has a thread stem 63 that passes through the holds ball 56 against seat 59 by means of nut 65.

In the skimming mode, controller 90 (FIG. 5) or controller 250 (FIG. 6) includes an additional shuttle valve 310 which drives the cylinder 71 at the well head by means of lines 230 and 231. The shuttle valve 310 has a main air input 312 connected to the constant air line 218 via restrictor/shut off 315. The shuttle valve 310 also has output 230 which is connected to cylinder 71 to lift the pump 30 and output 231 which is connected to cylinder 71 to lower the pump 30. The outputs 230 and 231 are connected to atmosphere via relief lines 316 and 313 and restrictors 318 and 314 respectively. When the sensing circuit 210 detects the liquid has reached level 77 in the sleeve, the amplifier 216 operates shuttle valve 310 via line 224. Compressed air on line 218 is supplied to the shuttle valve 310 via shut off 315. The compressed air on main input 312 is connected by the shuttle valve 310 to output 230 so that the cylinder retracts and lifts the top of the sleeve 64 of the pump 30 above the liquid hydrocarbon layer 136. As the cylinder 71 retracts air above the piston escapes through line 231, through shuttle valve 310, relief line 313, and restrictor 314. The lift speed is thereby controlled by restrictor 314. Once the air pulse on line 228 has ended and the liquid has dropped below 77, shuttle valve 310 is reversed by the sensing circuit 210. Reversing the shuttle valve 310 connects the main air at input 312 to the cylinder via output 231. Simultaneously line 230 from the cylinder is connected to exhaust via restrictor 318, and the cylinder lowers the pump 30 into the liquid hydrocarbon layer 136. The lowering speed is controlled by restrictor 318. The cylinder 71 can be disabled entirely by restrictor/shut off 315.

As the pump 30 is lowered (FIG. 3A), the liquid in layer 136 weirs (arrows 129 and 131) into the sleeve chamber 66 filling up the vessel chamber 40 and then filling up the sleeve chamber 66 until it reaches a predetermined level 77. Once the predetermined level 77 has been reached, the sense circuit 210 of controller 90 (FIG. 5) connects the air pulse line 228 to the pump line 72 and to the cylinder line 230 which causes the cylinder 71 to retract and the pump to cycle. In the skimming mode the pump 30 is alternatively lifted above the liquid level in the casing 120 and lowered back into the liquid so that the liquid that weirs into the sleeve chamber 66 is primarily floating the liquid hydrocarbons in layer 136. Consequently, a minimum amount of ground water is pumped to the surface thereby allowing clean up to begin even before permits to discharge the ground water at the site have been acquired.

I claim:

1. A pressure extraction pump system for recovery of the liquid hydrocarbons from ground water comprising:

(a) a well bore with liquid hydrocarbons and ground water therein;

(b) a pump suspended in the bore comprising:

(i) an enclosed vessel having a top, a bottom, and sides defining a vessel chamber with a vessel chamber cross-sectional area bound by the sides wherein the vessel has:

a. a top intake port with a top intake valve in its top;

b. a gas inlet port in its top; and c. an outlet port in its top which communicates with the vessel chamber adjacent the bottom via a pipe; and (ii) a sleeve having sides defining a sleeve chamber with a sleeve chamber cross-sectional area and which sleeve is attached to the top of the vessel, extends above the vessel, and is open at its top;

(c) First conduit means attached to the outlet port for delivering liquid from the outlet port of the vessel to a surface receptacle;

(d) a source of compressed gas;

(e) control means having a first input connected to the source of compressed gas, a first output connected via a second conduit means to the gas inlet port of the vessel, and sensing input connected to level sensing means within the sleeve chamber for determining the level of liquid hydrocarbon and ground water in the sleeve chamber and causing the control means to connect the compressed gas at its first input to its first output when the liquid hydrocarbon and ground water in the sleeve has reached a predetermined level in the sleeve; and (f) suspension means for suspending the pump in the bore.

2. The pump system of claim 1, wherein the suspension means includes reciprocating lift means operable under control of the control means to lift the top of the sleeve of the pump above the level of liquid in the bore when the liquid in the sleeve reaches the predetermined level, to hold the top of the sleeve above the liquid in the bore while the compressed gas is connected to the vessel's gas inlet port and to lower the top of the sleeve back into the liquid until the liquid in the sleeve reaches the predetermined level.

3. The pump system of claim 1 or 2, wherein the top intake valve in the vessel comprises a float valve which closes the top intake port when the vessel chamber is full of liquid and opens the top intake port when liquid flows from the sleeve chamber to the vessel chamber.

4. The pump system of claim 1, wherein the pump vessel further has a bottom intake port and a bottom intake valve in its bottom.

5. The pump system of claim 4, wherein the top intake valve in the vessel comprises a float valve which closes the top intake port when the vessel chamber is full of liquid and opens the top intake port when liquid flows from the sleeve chamber to the vessel chamber.

6. The pump system of claim 1 or 2, wherein the top intake valve in the vessel comprises a beam having a first end, a second end, and a length mounted on a pivot inside the vessel chamber, which pivot is located between the intake port and the gas inlet port, wherein the beam has a sealing disk mounted on its first end adjacent the intake port, for pivoting into engagement with and closing to intake port, has a weight on its second end, and has the pivot located along its length so that the sealing disk is pivoted into engagement with the intake port when the vessel chambers is full of liquid and is pivoted away from the intake port by liquid flowing from the sleeve chamber to the vessel chamber.

7. The pump system of claim 6, wherein the source of compressed gas produces timed pulses of compressed gas.

8. The pump system of claim 7, wherein the control means includes a quick exhaust means at its first output in order to relieve gas pressure in the vessel chamber once the pulse of compressed gas has ended.

9. A method of skimming liquid hydrocarbons which have formed a layer on top of ground water comprising the steps of:

(a) boring a wall bore through the layer of liquid hydrocarbons and into the ground water; and (b) lowering a pump into the well bore, the pump comprising:

(i) an enclosed vessel having a top, a bottom, and sides defining a vessel chamber with a vessel chamber cross-sectional area bound by the sides wherein the vessel has:

a. a top intake port with a top intake valve in its top;

b. a gas inlet port in its top; and c. an outlet port in its top which communicates with the vessel chamber adjacent the bottom via a pipe; and (ii) a sleeve having sides defining a sleeve chamber with a sleeve chamber cross-sectional area and which sleeve is attached to the top of the vessel, extends above the vessel, and is open at its top;

(c) sensing when the liquid hydrocarbons and ground water have reached a predetermined level in the sleeve;

(d) upon sensing the predetermined level connecting a source of compressed gas to the gas inlet to the pump for a predetermined time to evacuate the pump vessel; and (e) raising the top of the sleeve above liquid hydrocarbons and ground water in the bore during the predetermined time.

* * * * *